US005724478A

United States Patent [19]

Thweatt

[11] Patent Number: 5,724,478

[45] Date of Patent: Mar. 3, 1998

[54] LIQUID HEATER ASSEMBLY

[75] Inventor: Carl Thweatt, South Haven, Mich.

[73] Assignee: TruHeat Corporation, Allegan, Mich.

[21] Appl. No.: 647,713

[22] Filed: May 14, 1996

[51] Int. Cl.[6] ..... F24H 1/10

[52] U.S. Cl. ..... 392/484; 392/480; 392/496; 219/535

[58] Field of Search ..... 392/484, 480, 392/482, 483, 496, 470; 165/157, 158, 159, 168, 169, 171, 172, 173, 175, 181, 182, 185, 186, 277; 219/535, 544

[56] References Cited

U.S. PATENT DOCUMENTS

| | | | |
|---|---|---|---|
| 1,294,695 | 2/1919 | Osterheld . | |
| 1,355,867 | 10/1920 | Thompson . | |
| 1,723,981 | 8/1929 | Garcia . | |
| 1,894,987 | 1/1933 | Fusco | 165/172 |
| 2,196,683 | 4/1940 | Pickstone | 165/175 |
| 2,247,816 | 7/1941 | McIlrath . | |
| 2,419,429 | 4/1947 | Voiles . | |
| 2,510,235 | 6/1950 | Kögel . | |
| 2,611,585 | 9/1952 | Boling . | |
| 2,687,626 | 8/1954 | Bartlowe . | |
| 2,707,095 | 4/1955 | Parsons et al. . | |
| 2,722,733 | 11/1955 | Meyer et al. . | |
| 2,778,609 | 1/1957 | Peeps . | |
| 2,866,885 | 12/1958 | McILrath . | |
| 2,875,312 | 2/1959 | Norton . | |
| 2,955,184 | 10/1960 | Grindrod . | |
| 2,987,300 | 6/1961 | Greene . | |
| 3,004,330 | 10/1961 | Wilkins . | |
| 3,343,596 | 9/1967 | Kritzer . | |
| 3,413,442 | 11/1968 | Buiting et al. . | |
| 3,498,371 | 3/1970 | Zygiel . | |
| 3,501,619 | 3/1970 | Buiting et al. . | |
| 3,548,159 | 12/1970 | Ellstroem . | |
| 3,693,711 | 9/1972 | Zygiel . | |
| 3,782,456 | 1/1974 | Gusmer . | |
| 3,784,785 | 1/1974 | Noland . | |
| 3,834,458 | 9/1974 | Bilbro et al. . | |
| 3,953,923 | 5/1976 | Rygmyr . | |

(List continued on next page.)

FOREIGN PATENT DOCUMENTS

| | | |
|---|---|---|
| 0025916 | 4/1981 | European Pat. Off. . |
| WO8302992 | 9/1983 | European Pat. Off. . |
| WO8704887 | 8/1987 | European Pat. Off. . |
| 2454920 | 5/1976 | Germany . |
| 2500287 | 7/1976 | Germany . |
| 2521754 | 11/1976 | Germany . |
| 2537769 | 3/1977 | Germany . |
| 2738377 | 3/1979 | Germany . |
| 2804804 | 8/1979 | Germany . |
| 2903743 | 8/1980 | Germany . |
| 2942523 | 4/1981 | Germany . |
| 3112651 | 10/1982 | Germany . |
| 0861193 | 2/1961 | United Kingdom . |
| 1152170 | 5/1969 | United Kingdom . |
| 2029677 | 3/1980 | United Kingdom . |

*Primary Examiner*—Tu B. Hoang
*Attorney, Agent, or Firm*—Price, Heneveld, Cooper, DeWitt and Litton

[57] ABSTRACT

An elongated heat conductive assembly for heating water including a plurality of water passages equally spaced about the central axis of a heat conductive member in which an elongated electrical heating element is located on the central axis of the heat conductive member. Preferably the water passages are tubes located in a highly heat conductive member whereby the heat is trapped in the center of the conductive member from where it is transferred to the water. In one embodiment, caps are provided at the ends of the tubes so that the water enters a first end and flows to a second end and then back to the first end where it exits to the hot tub. In another embodiment, the water flows through one end to the other end from whence it flows to the hot tub. In another preferred embodiment the transfer of heat from the conductive member to the water flowing in the pipes is maximized by expanding the tubes against the walls of openings in the conductive member by applying hydraulic pressure inside the tubes.

25 Claims, 4 Drawing Sheets

U.S. PATENT DOCUMENTS 4,123,837 11/1978 Horner .
4,170,901 10/1979 Conkle et al. .
4,199,675 4/1980 Sharpless .
4,255,646 3/1981 Dragoy et al. .
4,334,141 6/1982 Roller et al. ..... 392/484
4,356,381 10/1982 Flaherty, Jr. et al. .
4,371,777 2/1983 Roller et al. .
4,371,778 2/1983 Meixner et al. .
4,460,819 7/1984 Eugster .
4,523,637 6/1985 Abramo .
4,778,977 10/1988 Bleckman .
4,814,584 3/1989 Bohlender et al. .
4,825,042 4/1989 Häuslein .
4,836,145 6/1989 Ronchi Née Marchesin .
4,855,569 8/1989 Wiedemann .
4,962,296 10/1990 Östbo .
5,127,465 7/1992 Fischer .
5,245,693 9/1993 Ford et al. ..... 392/470
5,257,341 10/1993 Austin, Jr. et al. .
5,265,318 11/1993 Shero .
5,409,057 4/1995 Zifferer .

LIQUID HEATER ASSEMBLY

This invention relates to a liquid heater assembly or unit and more particularly to a water heater unit for heating water passing therethrough. More specifically, the present invention relates to an "out-of-water" heater as contrasted with conventional immersed heaters for heating the water in flow systems such as those for hot tubs and spas.

BACKGROUND OF THE INVENTION

Many types of heater units have been designed for heating water in which the water is passed through a passageway located within a heat conducting member in which is located a heating element. The heat generated by the heating element is transferred from the heating element to the passageway for heating the water as it flows through the passageway. Various configurations of such heaters have been devised but have lacked efficiency in utilizing the heat generated by the heating element. This lack of efficiency is because of the location of the heating element with relation to the passageways flowing through the heat conductive member and also because of the inefficiency in transferring the heat from the heat conductive member to the water passageway or passageways extending through the heat conductive member.

BRIEF SUMMARY OF THE INVENTION

In accordance with my invention, I provide an elongated heat conductive member having a plurality of elongated water passageways equally spaced about the central axis of the heat conductive member. An elongated electrical heating element, electrically isolated from the heat conductive member, is located substantially on the central axis of the heat conductor member which is constructed of a solid heat conductive material substantially encompassing the entire outer walls of the tubular member for conducting heat radiated from the heating element to the water passageways.

The passageways in the heat conductive member are spaced one from another less than the cross-sectional dimension of the electrical heating element thereby minimizing the transmission of heat from the heating element to the outer surface of heat conducting member and maximizing the radiation of the heat to the passageway through which the water flows. In my preferred form the number of passageways through the heat conductive member should be sufficient (preferably four or more) to substantially surround the heating elements so as to substantially trap the heat radiated by the heating element in the central portion of the heat conductive member to heat the water from the inside while keeping the outer surface of the heat conductor member relative cool.

In the preferred form of this invention, the passageways through the elongated heat conductive member is provided by openings extending through the heat conductive member and receiving tubular members or tubes, preferably stainless steel, through which the water flows. The heating element is located in a central opening extending through the elongated heat conductive member. In one embodiment fluid passageway caps are attached to the ends of the tubes for causing the water to flow in one of the tubes at one of the ends of the heater unit, through all the tubes and out another tube at the same end of the unit. In another embodiment the tubes extend beyond the ends of the heat conductive member and on the ends thereof are located manifold fittings which combine the flow of water through the tubular members so that the flow is straight through each tube, the fittings are in turn connected to pipes extending to the hot tub, spa, or other devices.

In order to further maximize the transfer of the heat from the heating element into the tubes or tubular members, I have conceived expanding the tubes against the walls of openings to insure a tight fit. This facilitates maximum heat transfer from the heat conductive member through the tubes into the water. In accordance with this method, each tubular member is inserted into the elongated opening of the conductive member and then hydraulic fluid under high pressure is forced into the inside of the tubular member or tube thereby causing the wall of the tube to be forced against the wall of the opening in the conductive member. This is preferably accomplished by inserting a probe inside the tubular member and providing sealer members at selected positions to select the section of the tubular member to be expanded. The fluid is preferable forced into the inside of the tubular member by a high pressure hydraulic pump.

BRIEF DESCRIPTION OF THE DRAWINGS

My invention will now be described in detail with reference to the accompanying drawings wherein.

DETAILED DESCRIPTION

Figure 1:
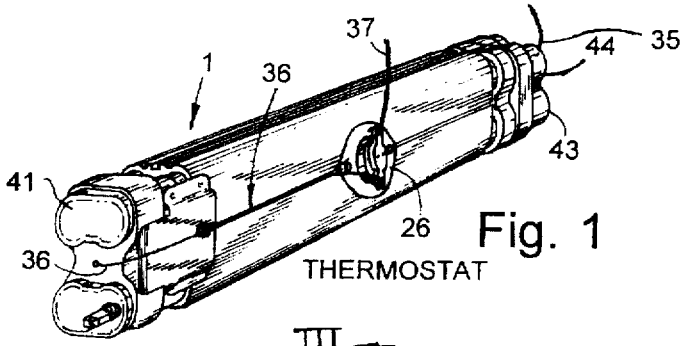
FIG. 1 is a side elevational perspective view of one of the embodiments of my heater unit invention.
Figure 2:
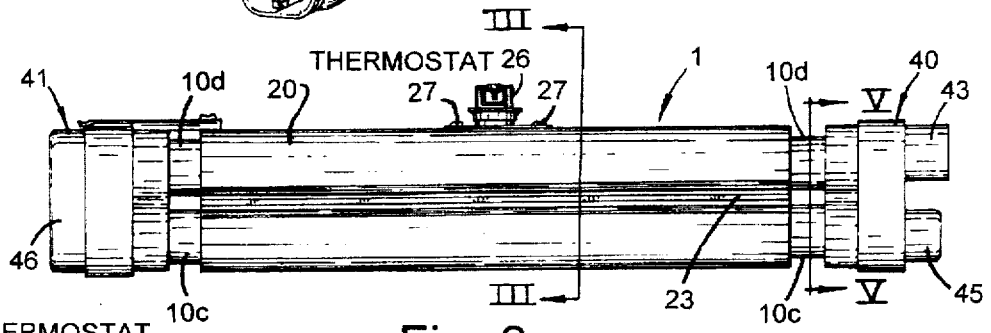
FIG. 2 is a top plan view of the same.
Figure 3:
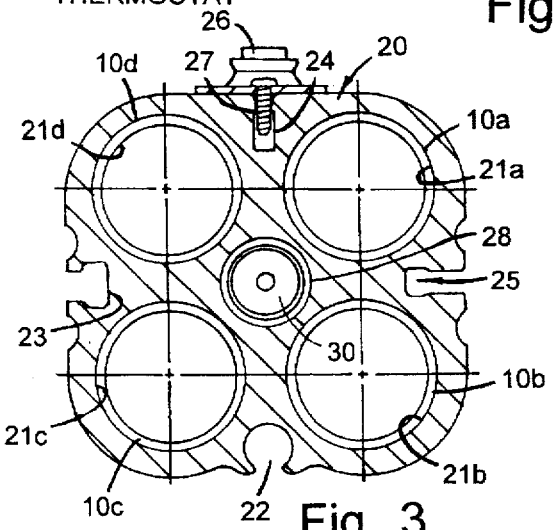
FIG. 3 is a cross sectional view of the heat conductor member taken along the plane III—III of FIG. 2.
Figure 5:
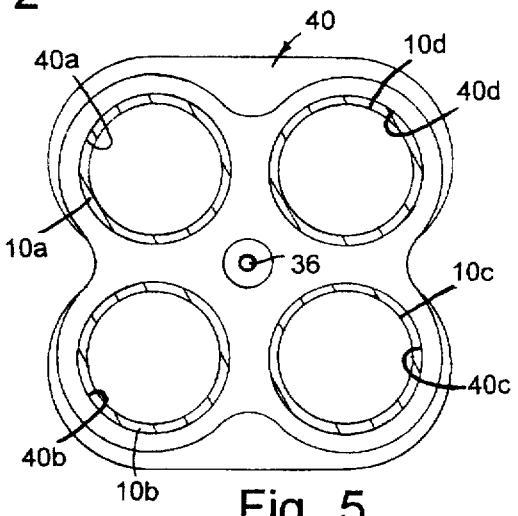
FIG. 5 is a cross-sectional view taken along the plane V—V of FIG. 2.
Figure 7:
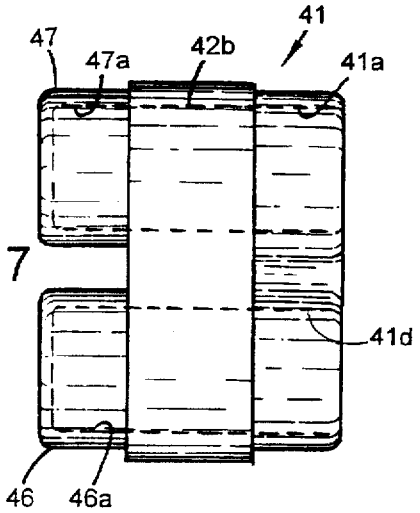
FIG. 7 is a top plan view of the end cap assembly of FIG. 6.

Referring to the drawings, particularly FIGS. 1, 2 and 3, reference numeral 1 designates one embodiment of my heating unit invention which includes the tubular members or tubes 10*a*, 10*b*, 10*c*, and 10*d* (FIG. 7), heat conductive member 20, and end cap assemblies 40 and 41. Heat conductive member 20 is constructed of a highly heat conductive materials such as aluminum and includes four openings 21*a*, 21*b*, 21*c*, and 21*d* (FIG. 3) through which the tubes 10*a*, 10*b*, 10*c*, and 10*d* extend therethrough, respectively. Tubes 10*a*, 10*b*, 10*c*, and 10*d* are constructed of stainless steel and are tightly fit within the openings 21*a*, 21*b*, 21*c*, and 21*d* by expanding them within the openings by a unique method as will be explained hereinafter.

Heat conductive member 20 preferably has the configuration as disclosed in FIG. 3 which in addition to the openings 21*a*, 21*b*, 21*c*, and 21*d* includes the recesses 22, 23, 24, and 25. Recess 22 is provided to receive a capillary bulb thermostat (not shown) to sense the temperature of the conductive member which is representative of the heat of the water flowing through the tubes. Recess 23 is provided to accommodate the head of a machine bolt (now shown) for mounting the heating unit 1 on a bracket or other type of support means. The slot or recess 24 is shown attaching a thermostat or over temperature protective device 26 by the sheet metal screws 27 as disclosed in both FIGS. 2 and 3. Recess or slot 25 is provided for the receiving a screw (not shown) for mounting purposes.

An opening 28 is located centrally on the axis X of the elongated heat conductive member and extends along its entire length. This opening 28 receives a heater element 30 which will be described in greater detail hereinafter.

Figure 10:
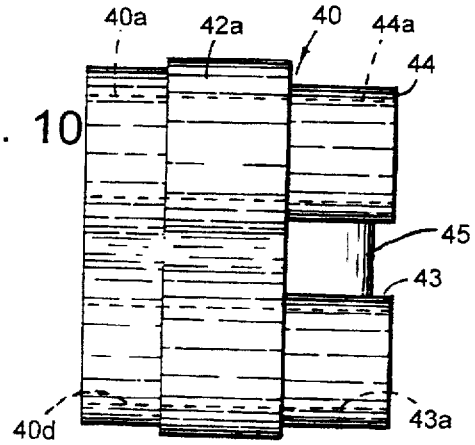
FIG. 10 is a plan view of the end cap assembly of FIG. 9.

As disclosed in FIGS. 1 and 2, the tubular members 10*a*, 10*b*, 10*c*, and 10*d* extend beyond both ends of the heat conductive member and on the ends of the tubular members are received the end cap assemblies 40 and 41 which in the embodiment of FIGS. 1 and 2 are different. End cap assembly 40 is best disclosed in FIGS. 1, 2, 5, and 9–11. It includes a body 42*a* having at one end openings 40*a*, 40*b*, 40*c*, and 40*d* respectively receiving one end of the tubes 10*a*, 10*b*, 10*c*, and 10*d*. Opening 40*d* communicates with the outlet opening 43*a* of outlet tube 43 at the opposite end of the end cap assembly 40 while opening 40*a* communicates with the inlet opening 44*a* of the inlet tube 44 (FIG. 10). Openings 40*c* and 40*b* communicate with the cavity 45*a* of the caps 45 which provides for flow of water from tube 10*c* to tube 10*b* as will be explained hereinafter. End cap assembly 40 also includes an opening 70 for the electrical line leading to the heater element 30.

Figure 8:
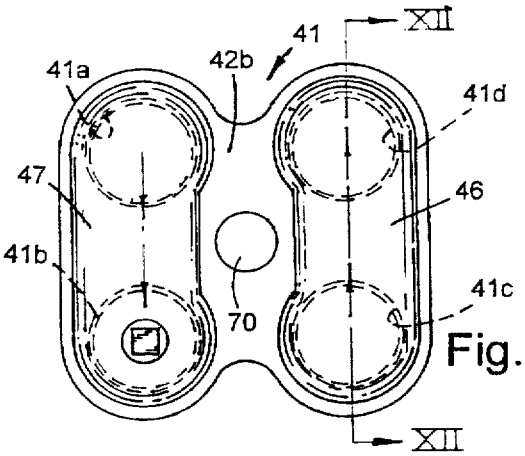
FIG. 8 is an end view of the end cap assembly of FIG. 6.
Figure 11:
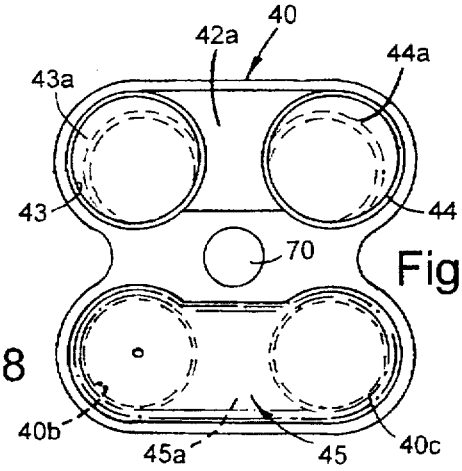
FIG. 11 is an end view of the end cap assembly of FIG. 9.
Figure 12:
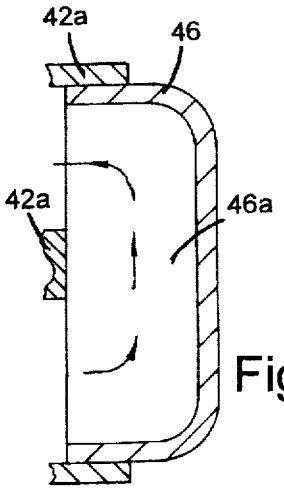
FIG. 12 is a cross-sectional view of one of the caps taken along the plane XII—XII of FIG. 8.

The end cap assembly 41 is very similar to the end cap assembly 40. It includes the body 42 having openings 41*a*, 41*b*, 41*c*, and 41*d*, as disclosed in dotted lines in FIG. 8. These openings extend through the entire body of the end cap assembly 41 and communicate with tubes 10*a*, 10*b*, 10*c*, and 10*d*, respectively. Mounted over the opposite ends of openings 41*c* and 41*d* is cap 46 like that disclosed in FIG. 12. Cap 46 is shaped to extend into a recess 48 in body 42*b*. It includes cavity 46*a* which extends over openings 41*d* and 41*c*. Cap 47 is like cap 46, its cavity 46*a* extends over openings 41*a* and 41*b*. Therefore cap 47 provides communication between openings 41*a* and 41*b* whereas cap 46 provides communication between the openings 41*c* and 41*d*.

Figure 4:
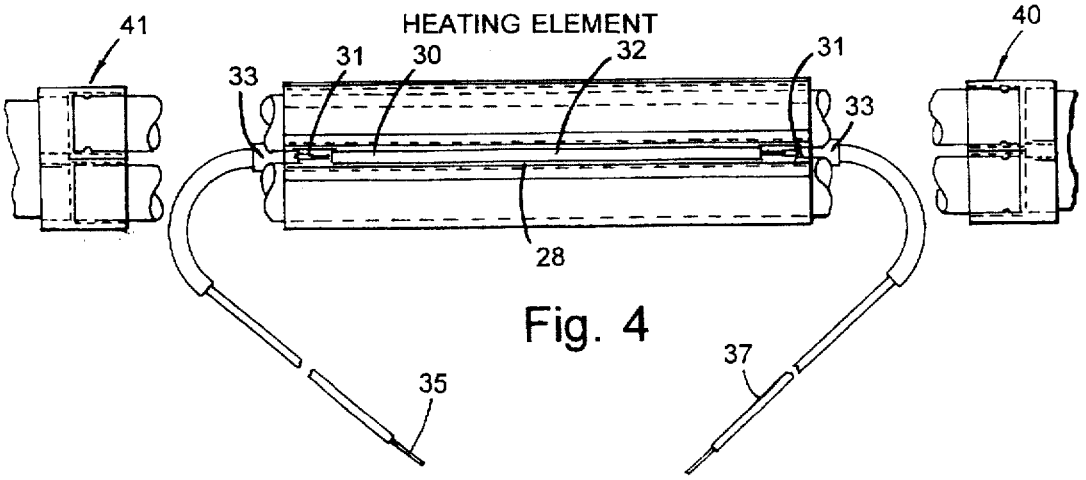
FIG. 4 is a side elevational, exploded view of several components of the heater of this invention.
Figure 6:
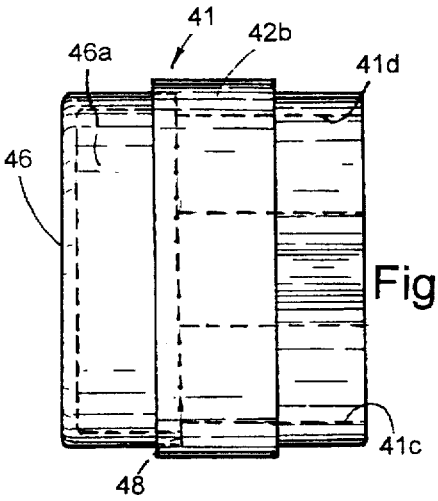
FIG. 6 is a side elevational view of the end cap assembly located on the left end of the heater unit of FIG. 2.
Figure 9:
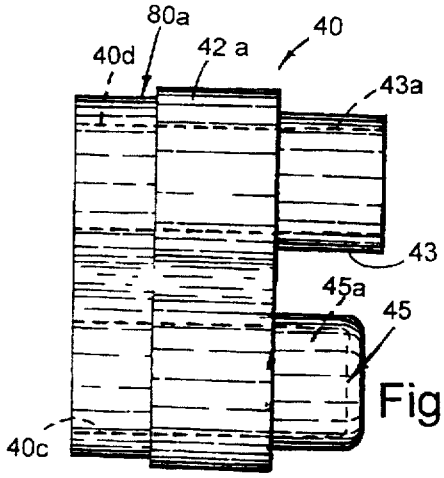
FIG. 9 is a side elevational view of the end cap assembly on the right end of the heater unit of FIG. 2.

FIG. 4 discloses in greater detail the heater element 30 located in opening 28 which extends the entire length of heat conductive member 20. It includes the resistant wire 31 located within the sheath 32 and connected at each end to a terminal 33 sometimes referred to as a cold pin. The end of the sheath is sealed with a epoxy. The terminal or cold pin 33 is electrically connected to an electric wire 35 at one end and at the other end to the wire 36 as disclosed in FIG. 1. Wire 36 is electrically connected to the thermostat 26 which is also connected to the wire 37. Wires 35 and 37 are in turn connected to the source of electricity.

OPERATION

Figure 13:
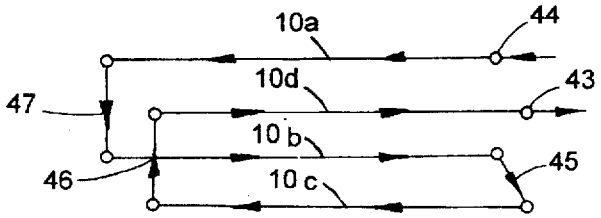
FIG. 13 is schematic diagram of the flow path of the water through the heater unit of FIGS. 1 and 2.

Having described all of the elements of the embodiment of FIGS. 1–8, the basic operation should he evident. One of the tubes 43 or 44 of end cap assembly 40 is connected to the outlet of a pump which circulates water through the hot tub or spa. In the embodiment of FIGS. 1–12 it makes no difference which of the tubes 43 or 44 is connected to the pump or the inlet of the hot tub or spa. However as illustrated in FIG. 13, assuming the pump is connected to tube 44, the water flows through tube 10*a*, downwardly through end cap 47, through tube 10*b*, across end cap 45, through tube 10*c*, upwardly through end cap 46, through tube 10*d* and out of outlet 43. With the heating element connected to a source of electricity, the heat generated by the heating element 30 is radiated outwardly from the central axis of the heat conductor member through the heat conducting member and is transmitted through the tubes 10*a*, 10*b*, 10*c*, and 10*d* into the water, heating the water to a desired temperature as determined by thermostat 26 which controls the electrical power supplied to the heating element 30. As the heat generated by the heater element is transmitted through the aluminum of the heat conductive member a maximum amount of such heat radiated by the heater element is transferred to the water rather than to the outer surface of the heat conductive member 20. The reason for this is the relatively narrow path for the flow of heat between the openings 21*a*, 21*b*, 21*c*, and 21*d*. The distance of the openings spaced one from another is less than the cross sectional dimension of the overall electrical heating element whereby transmission of heat between the openings to the exterior surface of the heat conductive element 20 is restricted. This results not only in great efficiency in the heating of the water but also eliminates high degree of heat on the surface of the heat conductive member 20 which keeps the outer surface that might be contacted by the users cool. It should be evident from the above description that this concept of the use of several tubes surrounding a heating element thereby traps the heat in the center of the heat conducting member 20 until it can be transferred to the water.

It should also be evident from the above description that in the use for hot tubs and spa in which chlorine chemicals are used to sanitize the water, the present invention substantially eliminates any serious corrosion such as experienced by current state-of-the-art heating units. The encased conduits through which the liquid passes is completely isolated from the heater and therefore the heater is isolated from the corrosive water. This also gives more freedom for the proper design of the heating element sheath. Exotic alloys generally required to prevent corrosion of the heating element sheaths are not required because the heating element is encased within the heat conductive member and completely isolated from any water. Therefore the life expectancy of the heater can be extended several fold.

The present invention also provides a major benefit of safety. As opposed to prior art heating devices in the spa industry in which the heater is immersed in the water along with the user, the present invention completely isolates the heater from the water that the user is immersed in. Further, the aluminum extrusion can be grounded ensuring that even when the heater shorts to ground the water will not be electrified. This is particularly important since spa water which is treated with chemicals to sanitize it, can become a conductor of electrical current and the user can become a conductive path if the voltage radiant develops across the water.

The present invention also allows one to heat liquids without having the liquid in contact with welds, cut material which will easily corrode, crevices in the metal, or metals which are easily damaged by heat. Therefore, as previously stated the present invention is a heater assembly which can be easily fabricated to avoid the normal corrosive pit falls that might be encountered in heaters for spas and hot tubs.

As previously stated, the present invention also provides for an extremely tight fit between the water conduit stainless steel tubes and the walls of the openings in the heat conductive member 20. It is extremely important that a tight fit is insured to obtain the maximum efficiency of the heater unit. Another aspect of this invention is the method by which such a tight fit is accomplished. Such method will now be described.

METHOD OF INSTALLING TUBES IN HEAT CONDUCTING MEMBER

Figure 18:
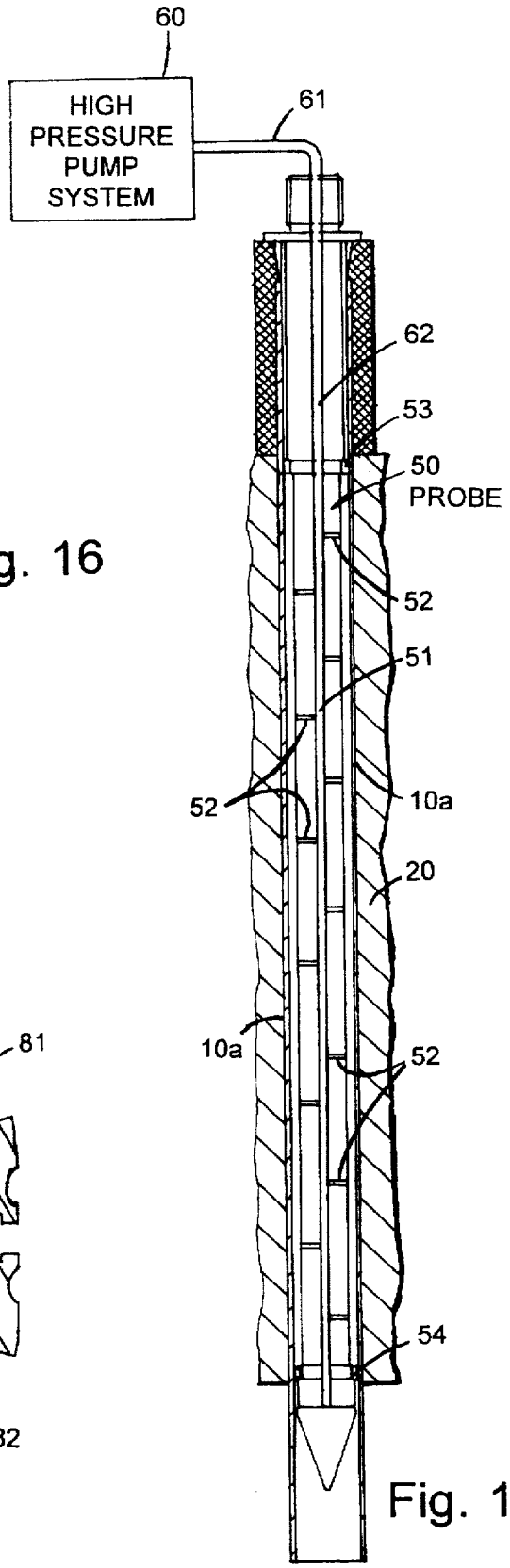
FIG. 18 discloses apparatus for expanding a tube within one of the openings of the heat conductive member.

FIG. 18 discloses one of the tubular members or tubes 10*a* located within the opening 21*a* of the heat conductive member 20. In accordance with the method of this invention, a probe 50 is inserted inside of the tube 10*a*. This probe 50 is an elongated member having a central passageway 51 and a plurality of openings 52 extending radially from the central passageway 51 so that water forced through the passageway 51 is forced outwardly against the inner walls of the tube 10*a*. O-rings 53 and 54 are located between tube 10*a* and probe 50 so that pressurized hydraulic fluid is contained between the "O"rings only. The inner passageway 51 communicates with a high pressure pump system 60 through a pipe 61. Thus, high pressure hydraulic fluid is forced through pipe 61, passageway 62, inner passageway 51 and the openings 52 so as to exert extremely high pressure against the inner wall of the tube 10*a* causing it to be expanded between the O-rings which prohibit and seal off the flow of the hydraulic fluid through both of the ends of the tube 10*a*. I have discovered that expanding the stainless steel tubes by this high pressure hydraulic method insures a tight fit and facilitates maximum heat transfer to the water as the water flows through the tubes of the heater unit 1 while heat is being radiated from the centrally located heating element 30.

MODIFICATION

Figure 14:
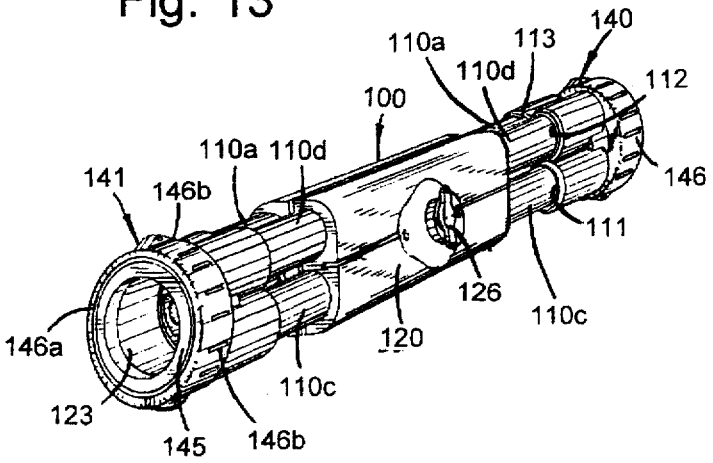
FIG. 14 is a side elevational, perspective view of another one of the embodiment of my heater unit invention.
Figure 15:
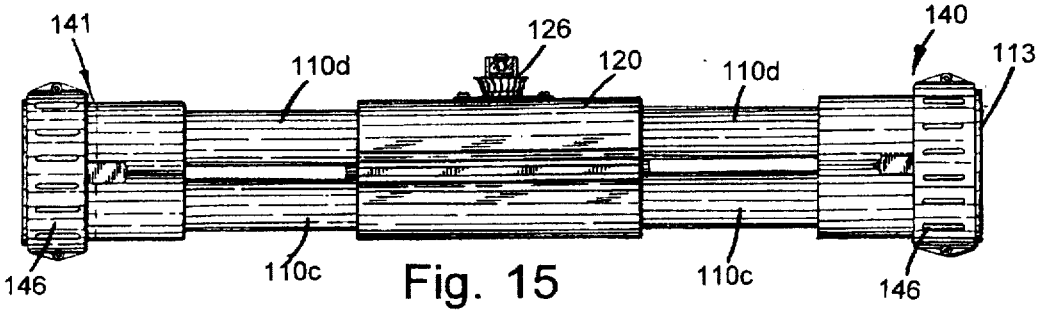
FIG. 15 is a top plan view of the heater unit of FIG. 14.
Figure 16:
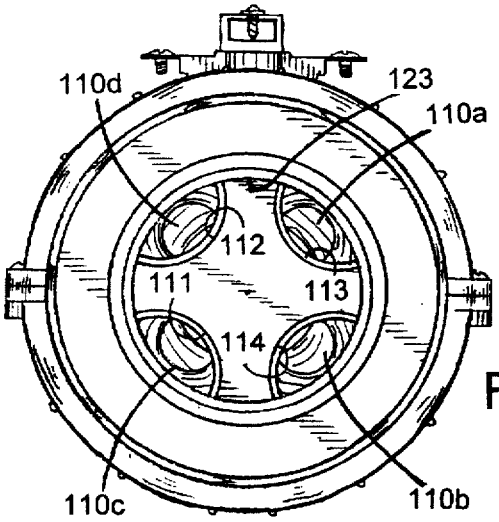
FIG. 16 is a end view of one of the ends of the heater unit of FIGS. 14 and 15.

FIGS. 14, 15, and 16 disclose a modified heating unit 100 with a thermostat 126 like that at 26. In this embodiment the water is caused to flow in one direction through all of the tubes 110*a*, 110*b*, 110*c*, and 110*d* which correspond to the tubes previously described in relation to FIGS. 1, 2, 3, and 4. The tubes 110*a*, 110*b*, 110*c*, and 110*d* pass through the heat conducting member 120 which is constructed of the same material as member 20. In fact, the construction of the heating unit 100 is substantially identical to unit 10 except for dimensions and the ends thereof. Instead of the end cap assemblies of heater unit 1, manifold assemblies 140 and 141 are provided. The manifold assemblies 140 and 141 are identical and therefore only one of the manifold assemblies will described in detail.

Manifold fitting 140 includes one end 140*a* having openings 111,112, 113, and 114 which receive the tubes 110*c*, 110*d*, 110*a*, and 110*b*, respectively. The openings such as openings 111, 112, 113, and 114 communicate with a manifold portion 123 which is configured to provide a flange 145 over which a two-piece collar 146 comprising the pieces 146*a* and 146*b* are connected together by screws. The interior circumference of the collar 146 is threaded to receive a pipe leading to a hot tub or spa or to the pump for the hot tub or spa.

It should become evident from the drawings and the above description that the operation of the heater unit 100 is substantially the same as that of the heating unit 1. The only difference is that the heating unit 100 passes the water through all of the tubes in one direction.

Figure 17:
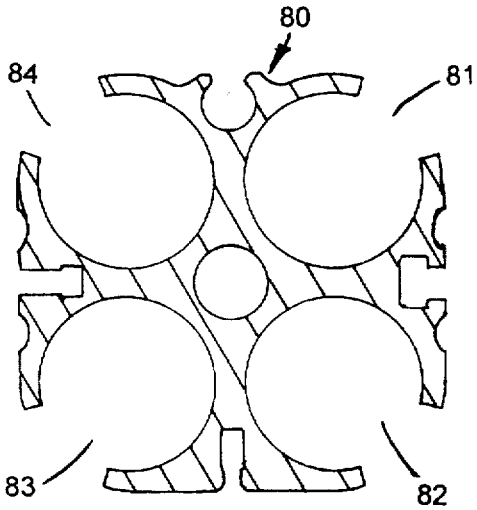
FIG. 17 is a modified version of the heat conductor member of FIG. 3.

Another possible modification is disclosed in FIG. 17 which discloses a heat conductive member 80 have substantially the same configuration as the heat conductive member of FIG. 3. The only difference is the elimination of certain sections of the conductive member around the tubes leaving spaces 81, 82, 83, and 84. This construction provides a savings in material.

Having described my invention, it should be understood that although I have disclosed preferred embodiments, to illustrate and describe the concepts and principles of my invention, it should be apparent to those skilled in the an that the illustrated embodiments may be modified without departing from such concepts and principles. I claim as my invention, not only the illustrated embodiment, but all such modifications, variations and equivalents thereof has come within this true spirit and scope of the following claims.

The embodiments of the invention in which an exclusive property or privilege is claimed are defined as follows:

1. A liquid heater including four or more elongated tubular members, said tubular members having a selected outer configurated shape;

an elongated heat conductive member having a central axis and four or more elongated openings having axes spaced about said central axis;

said openings each having a shape generally conforming to said selected outer configurated shape of said tubular members and each receiving one of said tubular members, each of the walls of said openings being in close contact with the outer wall of said tubular member which extends therethrough;

an elongated heating element electrically isolated from said heat conductive member, said elongated heating element having a cross sectional dimension greater than the distance said openings are spaced one from another; and said heat conductive member being constructed of solid heat conductive material substantially encompassing the entire outer walls of said tubular member for conducting heat radiated from said heating element to said tubular members for heating water flowing through said tubular members.

2. The liquid heater of claim 1 in which said heat conductive member is an extruded aluminum member.

3. The liquid heater of claim 1 in which said tubular members include first, second, third, and fourth tubes, a first fitting provided at one of the ends of the tubes, said first fitting including one inlet opening communicating with said first tube, an outlet opening communicating with said second tube, and a means for providing communication between said third and fourth tubes;

a second fitting located at the other of the ends of said tubes, said second fitting including means for providing communication between said first and third tubes and between said second and fourth tubes whereby forcing water in said inlet opening results in water flowing through all of said tubes and out of said outlet opening.

4. The liquid heater of claim 1 in which a manifold fitting is located on at least one end of said tubular members to combine the flow of water through said tubular members.

5. The liquid heater of claim 1 in which the cross sectional shapes of said openings and said tubular members are circular.

6. The liquid heater of claim 1 in which the heating element is located substantially on said central axis.

7. The liquid heater of claim 1 in which a number of said openings and tubular members are provided to substantially surround the heating element so as to substantially trap the heat radiated by said heating element in the central portion of the heat conductive member to heat the water from the inside while keeping the outer surface of the heat conductive member relatively cool.

8. The liquid heater of claim 2 in which the tubular members are stainless steel.

9. The liquid heater of claim 1 in which said heat conductive member includes a central opening located at said central axis and in which said electrical heating element is located.

10. The liquid heater of claim 1 in which said tubular members are members expanded outwardly of their axes against the walls of said openings to insure a tight fit so as to facilitate greater heat transfer.

11. The method of constructing a liquid heater in which heat is transferred to liquid flowing in a tubular member having a wall from a heat conductive member having at least one opening in which said tubular member is located comprising:

providing said heat conductive member having at least one opening;

inserting said tubular member into one of said at least one opening; and expanding said tubular member by forcing a fluid into the inside of said tubular member thereby causing said wall of said tubular member to be forced against the wall of said opening so as to insure a tight fit and facilitate greater heat transfer.

12. The method of claim 11 in which the fluid forced into said inside of said tubular member is accomplished by inserting a probe inside the tubular member and providing sealer members at selected positions to select the section of said tubular member to be expanded.

13. The method of claim 11 in which the fluid forced into the inside of said tubular member is created by a high pressure hydraulic pump.

14. A liquid heater having first, second, third, and fourth tubes arranged parallel to each other, said tubes terminating at a first end and at a second end; a first fitting at the first end and a second fitting at the second end; said first fitting including one inlet opening communicating with said first tube, an outlet opening communicating with said second tube, and a means for providing communication between said third and fourth tubes;

said second fitting including means for providing communication between said first and third tubes and between said second and fourth tubes whereby forcing water in said inlet opening results in water flowing through all of said tubes and out of said outlet opening.

15. The liquid heater of claim 14 wherein the liquid heater includes an elongated heat conductive member having an opening for each of said tubes and through which said tubes extend; and a heating element for heating said heat conductive member.

16. The liquid heater of claim 15 in which said heating element is located centrally of said tubes inside of said heat conductive member.

17. The liquid heater of claim 15 in which said tubular members are members expanded outwardly of their axes against the walls of said openings to insure a tight fit so as to facilitate greater heat transfer.

18. The liquid heater of claim 17 in which said tubular members are members expanded outwardly of their axes against the walls of said openings to insure a tight fit so as to facilitate greater heat transfer.

19. A liquid heater including a plurality of elongated tubular members, said tubular members having a selected outer configurated shape;

an elongated heat conductive member having a central axis and a plurality of elongated openings having axes spaced about said central axis;

said openings each having a shape generally conforming to said selected outer configurated shape of said tubular members and each receiving one of said tubular members, each of the walls of said openings being in close contact with the outer wall of said tubular member which extends therethrough;

said tubular members being expanded outwardly of their axes against the walls of said openings by a probe to ensure a tight fit so as to facilitate greater heat transfer;

an elongated heating element electrically isolated from said heat conductive member; and said heat conductive member being constructed of solid heat conductive material substantially encompassing the entire outer walls of said tubular member for conducting heat radiated from said heating element to said tubular members for heating water flowing through said tubular members.

20. The liquid heater of claim 19 wherein said elongated heat conductive member is an extruded aluminum member.

21. The liquid heater of claim 19 wherein a manifold fitting is located on at least one end of said tubular members to combine the flow of water through said tubular members.

22. The liquid heater of claim 19 wherein the cross sectional shapes of said openings and said tubular members are circular.

23. The liquid heater of claim 19 wherein said tubular members are stainless steel.

24. The liquid heater of claim 19 wherein said elongated heating element has a cross sectional dimension greater than the distance said openings are spaced one from another.

25. A liquid heater including a plurality of elongated tubular members, said tubular members having a selected outer configured shaped;

an elongated heat conductive member having a central axis and a plurality of elongated openings having axes spaced about said central axis;

said openings each having a shape generally conforming to said selected outer configurated shape of said tubular members and each receiving one of said tubular members, each of the walls of said openings being in close contact with the outer wall of said tubular member which extends therethrough;

said tubular members being expanded outwardly of their axes against the walls of said openings to ensure a tight fit so as to facilitate heat transfer;

an elongated heating element electrically isolated from said heat conductive member; and said heat conductive member being constructed of solid heat conductive material substantially encompassing the entire outer walls of said tubular member for conducting heat radiated from said heating element to said tubular members for heating water flowing through said tubular members.

* * * * *

UNITED STATES PATENT AND TRADEMARK OFFICE

CERTIFICATE OF CORRECTION

PATENT NO. : 5,724,478

DATED : March 3, 1998

INVENTOR(S) : Carl Thweatt

It is certified that error appears in the above-identified patent and that said Letters Patent is hereby corrected as shown below:

Column 1, line 52;
"is" should be --are--;

Column 2, line 25;
"cross sectional" should be --cross-sectional--;

Column 2, line 50;
"a" should be --an--;

Column 2, line 65;
"materials" should be --material--;

Column 3, line 58;
"a" should be --an-;

Column 4, lines 25 and 26;
"cross sectional" should be --cross-sectional--;

Column 5, line 25;
" "O" rings" should be --O-rings--;

Column 5, line 50;
"10" should be --1--;

Column 6, line 5;
"have" should be --having--;

Column 6, line 14;
"an" should be --art--;

UNITED STATES PATENT AND TRADEMARK OFFICE

CERTIFICATE OF CORRECTION

PATENT NO. : 5,724,478

DATED : March 3, 1998

INVENTOR(S) : Carl Thweatt

It is certified that error appears in the above-identified patent and that said Letters Patent is hereby corrected as shown below:

Column 6, line 36;
"cross sectional" should be --cross-sectional--;

Column 6, line 63;
"cross sectional" should be --cross-sectional--;

Column 8, line 1;
"17" should be --16--;

Column 8, lines 33 and 34;
"cross sectional" should be --cross-sectional--;

Column 8, line 39;
"cross sectional" should be --cross-sectional--;

Column 8, line 43;
"shaped" should be --shape--.

Signed and Sealed this

Fifteenth Day of December, 1998

Bruce Lehman

*Attest:*

BRUCE LEHMAN

*Attesting Officer*

*Commissioner of Patents and Trademarks*